US005995787A

United States Patent [19]

Takeda et al.

[11] Patent Number: 5,995,787

[45] Date of Patent: Nov. 30, 1999

[54] IMAGE FORMING APPARATUS AND IMAGE FORMING METHOD

[75] Inventors: Katsuhiko Takeda, Itami; Akihito Ikegawa, Sakai; Tomoo Izumi, Osaka; Satoshi Deishi, Ibaraki, all of Japan

[73] Assignee: Minolta Co., Ltd., Osaka, Japan

[21] Appl. No.: 09/053,655

[22] Filed: Apr. 2, 1998

[30] Foreign Application Priority Data

Apr. 4, 1997 [JP] Japan ..... 9-086219
Apr. 8, 1997 [JP] Japan ..... 9-089280

[51] Int. Cl.[6] ..... B41J 2/00

[52] U.S. Cl. ..... 399/237

[58] Field of Search ..... 399/237–239, 399/233, 57; 347/112, 155; 430/32, 112

[56] References Cited

U.S. PATENT DOCUMENTS

| | | | |
|---|---|---|---|
| 4,272,599 | 6/1981 | Moradzadeh | 430/100 |
| 5,848,332 | 12/1998 | Machida | 399/139 |
| 5,870,129 | 2/1999 | Ikegawa et al. | 347/155 |

FOREIGN PATENT DOCUMENTS

| | | |
|---|---|---|
| 4-64481 | 2/1992 | Japan . |
| 7-271107 | 10/1995 | Japan . |
| 7-271198 | 10/1995 | Japan . |
| 8-197842 | 8/1996 | Japan . |
| 10-282793 | 10/1998 | Japan . |
| 10-282794 | 10/1998 | Japan . |

*Primary Examiner*—Arthur T. Grimley
*Assistant Examiner*—Quana Grainger
*Attorney, Agent, or Firm*—Burns, Doane, Swecker & Mathis, LLP

[57] ABSTRACT

In the present invention, an electrostatic latent image is formed on the surface of an image carrying member, while ink having a tack value of not less than one is used as ink in an ink developing device. The ink is held in an ink carrying member. The ink held in the ink carrying member is brought into contact with the surface of the image carrying member to supply the ink to the electrostatic latent image formed on the surface of the image carrying member, to form an ink image on the surface of the image carrying member. The ink image is transferred onto a recording medium from the surface of the image carrying member by a transfer device.

18 Claims, 8 Drawing Sheets

IMAGE FORMING APPARATUS AND IMAGE FORMING METHOD

BACKGROUND OF THE INVENTION

This application is based on applications Nos. 86219/1997 and 89280/1997 filed in Japan, the contents of which is hereby incorporated by reference.

1. Field of the Invention

The present invention relates to an image forming apparatus and an image forming method in which ink is supplied to an electrostatic latent image formed on an image carrying member, to form an ink image on the image carrying member, and the ink image is transferred to a recording medium, to form an image on the recording medium.

2. Description of the Related Art

Conventionally, a copying machine, a printer, and so on utilizing an electrophotographic system have been used as an image forming apparatus. In such an image forming apparatus, an electrostatic latent image is formed on the surface of an image carrying member, and the electrostatic latent image is developed, and is then transferred to a recording medium such as paper, to form an image on the recording medium.

Known as one of such an electrophotographic image forming apparatus is one using a liquid developer obtained by dispersing colored resin particles (toner particles) in a carrier liquid in order to develop an electrostatic latent image, as disclosed in JP-A-7-271107.

The liquid developer used in the electrophotographic apparatus is generally one obtained by dispersing charged toner particles in an insulating carrier liquid. The toner particles are selectively consumed from the liquid developer as an image is formed. When the liquid developer is thus used, therefore, the density of the toner particles in the carrier liquid must be managed. The management is troublesome. Further, a large part of the carrier liquid is repeatedly used, so that the liquid developer is liable to be degraded.

Furthermore, in the electrophotographic apparatus using the liquid developer, when the image is formed on a recording medium such as copying paper, a fixing device for fixing a toner image transferred onto the recording medium, for example, is required. Therefore, the apparatus is complicated and is increased in size, for example.

Conventionally, an image forming apparatus so constructed that an electrostatic latent image is formed on the surface of an image carrying member, ink held in an ink carrying member is brought into contact with the surface of the image carrying member having the electrostatic latent image thus formed thereon, the ink is made to adhere to a portion of the electrostatic latent image formed on the surface of the image carrying member, to form an ink image corresponding to the electrostatic latent image on the surface of the image carrying member, and the ink image is transferred onto a recording medium such as paper, an OHP sheet, or the like from the surface of the image carrying member, to form an image has been proposed, as disclosed in U.S. Pat. No. 4,272,599.

In the image forming apparatus, however, there are some problems. For example, the ink does not sufficiently adhere on the portion of the electrostatic latent image formed on the surface of the image carrying member, so that the density of the formed image is decreased, and voids are created in the formed image. Contrary to this, the ink also adheres to a portion having no electrostatic latent image formed thereon in the image carrying member, so that the formed image is fogged.

SUMMARY OF THE INVENTION

An object of the present invention is to make, in supplying ink to an electrostatic latent image formed on the surface of an image carrying member to form an ink image, ink suitably adhere to a portion of the electrostatic latent image formed on the surface of the image carrying member, to obtain a good image having a sufficient image density and having no voids.

Another object of the present invention is to prevent, in supplying ink to an electrostatic latent image formed on the surface of an image carrying member to form an ink image, the ink from adhering on the surface of the image carrying member having no electrostatic latent image formed thereon, to obtain a good image which is not fogged.

Still another object of the present invention is to adjust, in bringing ink held in an ink carrying member into contact with the surface of an image carrying member having an electrostatic latent image formed thereon, to supply the ink to the electrostatic latent image formed on the surface of the image carrying member, the thickness of the ink held in the ink carrying member simply and suitably.

In a first image forming apparatus and a first image forming method according to the present invention, an electrostatic latent image is formed on the surface of an image carrying member. On the other hand, an example of ink in an ink developing device is one having a tack value of not less than one. The ink is held in an ink carrying member. The ink held in the ink carrying member is brought into contact with the surface of the image carrying member to supply the ink to the electrostatic latent image formed on the surface of the image carrying member, to form an ink image on the surface of the image carrying member. The ink image is transferred onto a recording medium from the surface of the image carrying member by a transfer device.

In bringing the ink held on the surface of the ink carrying member into contact with the surface of the image carrying member having the electrostatic latent image formed thereon as described above, to form the ink image corresponding to the electrostatic latent image on the surface of the image carrying member, if the tack value of the used ink is low, the ink is liable to be cut. When the ink having a low tack value is held on the surface of the image carrying member and is brought into contact with the surface of the image carrying member, the ink is cut to adhere on the surface of the image carrying member even in a portion having no electrostatic latent image formed thereon, so that an image for med on the recording medium is liable to be fogged.

As in the first image forming apparatus and the first image forming method according to the present invention, when the ink having a tack value of not less than one is used, and the ink is held on the surface of the ink carrying member and is brought into contact with the surface of the image carrying member having the electrostatic latent image formed thereon, the ink is prevented from adhering on the surface of the image carrying member having no electrostatic latent image formed thereon, while sufficiently adhering on only a portion corresponding to the electrostatic latent image, so that the ink image corresponding to the electrostatic latent image is formed on the surface of the image carrying member. The ink image is transferred onto the recording medium. Consequently, the image formed on the recording medium is prevented from being fogged, so that the formed image is a good image having a sufficient image density.

In forming the ink image corresponding to the electrostatic latent image on the surface of the image carrying member using the above-mentioned ink, when a time period during which the image carrying member and the ink are in contact with each other differs, the most suitable tack value of the used ink changes. In a case where the time period during which the image carrying member and the ink are in contact with each other is long, the ink also easily adheres on the portion having no electrostatic latent image formed thereon. Therefore, ink having a tack value which is high in some degree is used. On the other hand, in a case where the time period during which the image carrying member and the ink are in contact with each other is short, if the ink having a high tack value is used, the ink is difficult to cut, so that the ink may not be sufficiently supplied to the surface of the image carrying member having the electrostatic latent image formed thereon. Therefore, it is generally preferable to use ink having a tack value of less than 80.

In recent years, in order to prevent the ink from adhering on the portion having no electrostatic latent image formed thereon, a non-conductive release agent such as silicone oil has been applied to the surface of the image carrying member having the electrostatic latent image formed thereon. When the non-conductive release agent is thus applied to the surface of the image carrying member, it is possible to use ink having a lower tack value than that in a case where no release agent is applied thereto.

In a second image forming apparatus and a second image forming method according to the present invention, the thickness of ink held on the surface of an ink carrying member is adjusted by a regulating plate in an ink developing device, and the ink held on the surface of the ink carrying member is brought into contact with the surface of an image carrying member having an electrostatic latent image formed thereon, to form an ink image corresponding to the electrostatic latent image on the surface of the image carrying member.

In the second image forming apparatus and the second image forming method according to the present invention, in a case where Vs(mm/s) is taken as the speed at which the surface of the ink carrying member is moved, E(kgf/mm$^2$) is taken as the Young's modulus of the regulating plate, L(mm) is taken as the length of a portion where the regulating plate is in contact with the ink in the direction in which the ink carrying member is moved, t(mm) is taken as the thickness of the regulating plate, and $\eta$ ($\gamma$)(cP) is taken as the viscosity of the ink at the shear rate $\gamma$ (/s) thereof, the relationship of $44.8\times10^{-6}\times E\times t^3/(L^4\times Vs) \leqq \eta(\gamma) \leqq 902.8\times10^{-6}\times E\times t^3/(L^4\times Vs)$ is satisfied. The viscosity $\eta$ ($\gamma$) is the viscosity of the ink at the shear rate $\gamma$ (/s) of the ink in a potion between the ink carrying member and the regulating plate.

When the ink whose viscosity $\eta$ ($\gamma$) at the shear rate $\gamma$ (/s) is in the above-mentioned range is used as described above, and the thickness of the ink on the surface of the ink carrying member holding the ink is adjusted by the regulating plate, the thickness of the ink on the surface of the ink carrying member is so adjusted as to be a suitable thickness of approximately 5 to 20 $\mu$m.

When the ink thus held so as to have a suitable thickness on the surface of the ink carrying member is brought into contact with the surface of the image carrying member having the electrostatic latent image formed thereon, to form the ink image corresponding to the electrostatic latent image on the surface of the image carrying member, the ink is prevented from adhering on the surface of the image carrying member having no electrostatic latent image formed thereon, while sufficiently adhering on only a portion corresponding to the electrostatic latent image. Consequently, the formed image is prevented from being fogged, so that th e formed image is a good image having a sufficient image density.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

Figure 1:
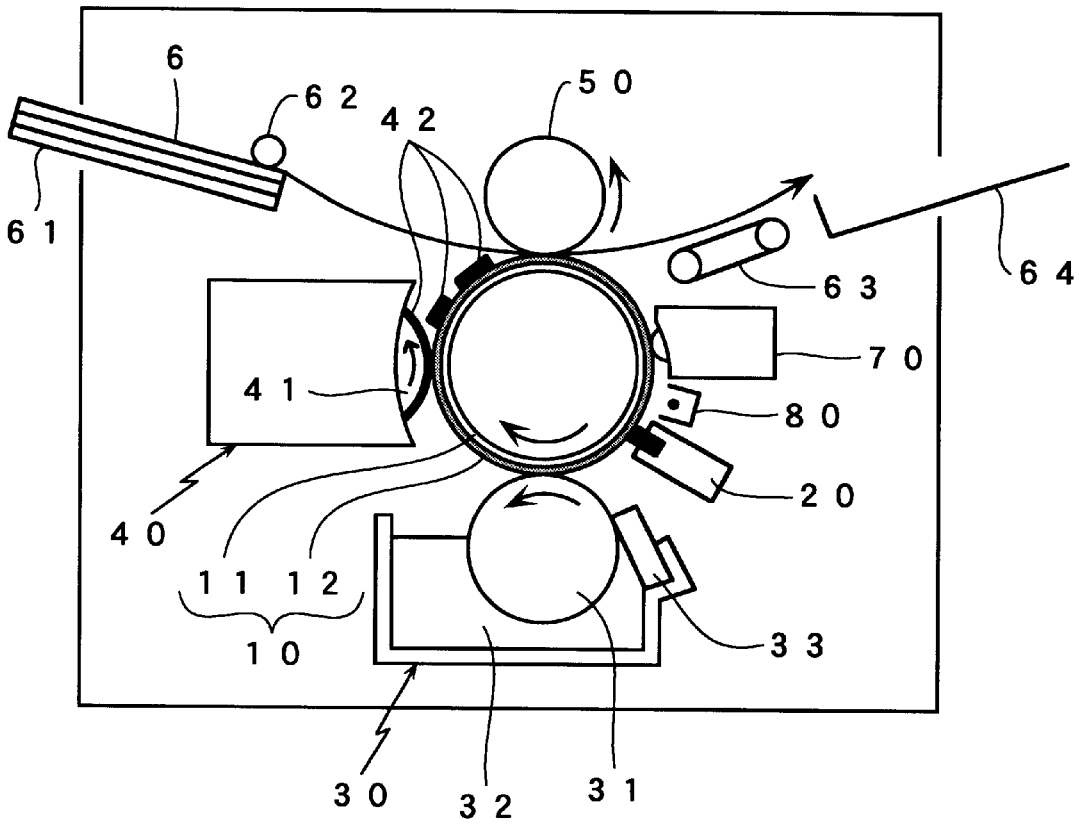
FIG. 1 is a schematic explanatory view of an image forming apparatus according to an embodiment 1 of the present invention.

Description is made of preferred embodiments of the present invention.

Examples of an image carrying member used in the present invention include one so constructed that a dielectric layer is formed on the surface of an electrically conductive member and an electrophotographic photoreceptor so constructed that a photosensitive layer is formed on the surface of an electrically conductive member.

In the image carrying member, examples of a material composing the electrically conductive member include metals such as aluminum, iron, copper, nickel, SUS, gold, silver, chromium, platinum, tin, and titanium, and alloys of the metals, and resins having any of the conductive materials dispersed therein. In dispersing any of the conductive materials in the resin as described above, it is possible to use, as the resin, polyethylene, polypropylene, polyvinyl alcohol, polyvinyl acetate, an ethylene-vinyl acetate copolymer, polymethyl methacrylate, polycarbonate, polystyrene, an acrylonitrile-methyl acrylate copolymer, an acrylonitrile-butadiene-styrene copolymer, polyethylene terephthalate, a polyurethane elastomer, polyamide, polyimide, etc.

Examples of a material composing the dielectric layer provided on the electrically conductive member include resins such as polyester, polypropylene, polyvinyl alcohol, polyvinyl acetate, an ethylene-vinyl acetate copolymer, polymethyl methacrylate, polycarbonate, polystyrene, an acrylonitrile-methyl acrylate copolymer, an acrylonitrile-butadiene-styrene copolymer, polyethylene terephthalate, polyurethane elastomer, viscose rayon, cellulose nitrate, cellulose acetate, cellulose triacetate, cellulose propionate, cellulose acetate butyrate, ethyl cellulose, regenerated cellulose, polyamide (nylon 6, nylon 66, nylon 11, nylon 12, nylon 46, etc.), polyimide, polysulfone, polyether sulfone, polyvinyl chloride, a vinyl chloride-vinyl acetate copolymer, polyvinylidene chloride, a vinylidene chloride-vinyl chloride copolymer, a vinyl nitrile rubber alloy, polytetrafluoroethylene, polychlorofluoroethylene, polyvinyl fluoride, and polyvinylidene fluoride, and inorganic materials composed of ceramics such as $Al_2O_3$, $SiO_2$, or $TiO_2$. It is also possible to use a combination of two or more types of dielectric materials.

As the photosensitive layer provided on the electrically conductive member, it is possible to use a photosensitive layer which is generally used in the electrophotographic photoreceptor.

In forming the electrostatic latent image on the image carrying member, when an image carrying member so constructed that a dielectric layer is formed on the surface of an electrically conductive member is used as the image carrying member, a discharger, an electrostatic head of an ion flow type, or the like for applying charge corresponding to an image to the dielectric layer on the surface of the image carrying member to form an electrostatic latent image is used.

On the other hand, when the photoreceptor so constructed that the photosensitive layer is formed on the surface of the electrically conductive member is used as the image carrying member, a charger for charging the surface of the image carrying member and various types of exposing devices such as a laser device for exposing the charged surface of the image carrying member are used in combination.

Image forming apparatuses and image forming methods according to embodiments of the present invention will be specifically described on the basis of the accompanying drawings.

(Embodiment 1)

In the present embodiment 1, an image carrying member 10 so constructed that a dielectric layer 12 is formed on the surface of a cylindrical electrically conductive member 11 is used, as shown in FIG. 1. The image carrying member 10 is not limited to one in the above-mentioned cylindrical shape. Any image carrying member 10 so constructed that a dielectric layer 12 is formed on an electrically conductive member 11 may be used. For example, it may be one in a belt shape.

An electrostatic latent image is formed on the surface of the image carrying member 10 by a latent image forming device 20 while rotating the image carrying member 10.

In the present embodiment, as the latent image forming device 20, a discharge electrode 20 formed in a multi stylus shape is used. Discharges are selectively induced from the discharge electrode 20, to form an electrostatic latent image on the surface of the image carrying member 10. However, the latent image forming device 20 is not limited to the above-mentioned discharge electrode 20. Any latent image forming device so constructed that an electrostatic latent image can be formed by selectively charging the surface of the image carrying member 10 may be used.

In forming the electrostatic latent image on the surface of the image carrying member 10 by the latent image forming device 20 as described above, when the surface potential of the electrostatic latent image is low, ink 42 is not sufficiently supplied to the image carrying member 10, so that an image having a sufficient image density may not be obtained. Contrary to this, when the surface potential of the electrostatic latent image is too high, voids or the like may be created in a portion of a formed image. Therefore, it is preferable that the absolute value of the surface potential in a portion of the electrostatic latent image is in the range of 200 to 2000 V.

In the present embodiment, a release agent 32 is applied to the surface of the image carrying member 10 having the electrostatic latent image formed thereon as described above by a release agent application device 30, and the ink 42 is brought into contact with the surface of the image carrying member 10 thus coated with the release agent 32 to perform development by an ink developing device 40.

In the above-mentioned release agent application device 30, silicone oil 32 is used as the release agent 32, and a part of an application roller 31 is immersed in the silicone oil 32, to hold the silicone oil 32 on the surface of the application roller 31. The application roller 31 is rotated, and the amount of the silicone oil 32 on th e surface of the application roller 31 is regulated by a regulating blade 33, to apply the silicone oil 32 to the surface of the image carrying member 10 having the electrostatic latent image formed thereon so as to have a suitable thickness from the application roller 31.

Although another known release a gent can be also used in addition to the silicone oil as the release agent 32, it is preferable that the silicone oil is used from the viewpoint of facility for handling, for example.

In applying the release agent 32 to the surface of the image carrying member 10 having the electrostatic latent image formed thereon from the release agent application device 30, if the amount of application of the release agent 32 applied to the surface of the image carrying member 10 is small, the ink 42 is also supplied to a portion having no electrostatic latent image formed thereon, so that the formed image may be fogged in a case where the ink 42 is brought into contact with the surface of the image carrying member 10 coated with the release agent 32 to perform development by the ink developing device 40 as described later. Contrary to this, if the amount of application of the release agent 32 applied to the surface of the image carrying member 10 is too large, the ink 42 is not satisfactorily supplied to a portion having the electrostatic latent image formed thereon, so that the formed image may not be suitable because the density thereof is decreased, for example. When the release agent 32 is applied to the surface of the image carrying member 32, therefore, it is preferable that the thickness of the release agent 32 on the surface of the image carrying member 10 is in the range of 0.1 to 10 $\mu$m.

In supplying the ink 42 from the ink developing device 40 to the surface of the image carrying member 10 coated with the release agent 32 composed of the silicone oil as described above, ink having a tack value of not less than one is used as the ink 42.

The ink 42 having a tack value of not less than one is thus held on the surface of an ink carrying member 41, to rotate the ink carrying member 41, and the thickness of the ink 42 held in the ink carrying member 41 is so adjusted as to be a predetermined thickness, after which the ink 42 is conveyed to a portion opposite to the image carrying member 10.

In adjusting the thickness of the ink 42 on the surface of the ink carrying member 41 as described above, it is preferable that the thickness of the ink 42 on the surface of the ink carrying member 41 is in the range of 1 to 50 $\mu$m in order to prevent the ink 42 from being supplied to the portion having no electrostatic latent image formed thereon in the image carrying member 10 as well as to supply the ink 42 in sufficient amounts to the portion having the electrostatic latent image formed thereon.

The ink 42 having a predetermined thickness on the ink carrying member 41 as described above is brought into contact with the surface of the image carrying member 10 coated with the silicone oil 32. When the ink 42 held on the ink carrying member 41 is thus brought into contact with the surface of the image carrying member 10 coated with the silicone oil 32, the ink 42 is hardly supplied to the portion having no electrostatic latent image formed thereon in the image carrying member 10, and the ink 42 is sufficiently supplied to only the portion having the electrostatic latent image formed thereon, so that an ink image corresponding to the electrostatic latent image 10 is formed on the image carrying member 10.

Any ink having a tack value of not less than one as described above may be used as the ink 42 in the present embodiment. For example, it is possible to use ink 42 composed of a colorant, a vehicle, an additive added as required, and so on which is represented by ink for printing, for example. Lithographic ink used for lithographic printing out of various types of printing ink is preferably used, and oily ink is particularly preferable.

It is possible to use, as the colorant, various known colorants such as pigments. Examples of black pigments include carbon black. Examples of yellow pigments include yellow oxide. Examples of red pigments include lake red C, brilliant carmine 6B, rhodamine 6GPTMA toner, and red iron oxide. Examples of blue pigments include prussian blue and cobalt blue.

It is possible to use, as the vehicle, oils, resins, solvents, plasticizers, etc. Examples of the oil include treated oils, mineral oils, etc. in addition to vegetable oils such as linseed oil and china wood oil. Examples of the resin include synthetic resins such as phenol resin modified by rosin, natural resins such as gilsonite, natural resin derivatives, etc. Examples of the solvent include high-boiling petroleum solvents such as tetradecane and pentadecane. Further, the plasticizer, for example, adipic acid ester, sebacic acid ester, paraffin chloride, etc. may be added as required.

Examples of the additive added as required to the ink 42 include waxes such as vegetable waxes, animal waxes, mineral waxes, and synthetic waxes, dryers such as metal soap and organic acids, surface-active agents such as lecithin and sorbitan fatty acid ester, and gelling agents such as hydrogenated castor oil and aluminum soap.

Although the details of the principle upon which when the ink 42 held on the ink carrying member 41 is brought into contact with the surface of the image carrying member 10 coated with the release agent 32 as described above, the ink 42 is not supplied to the portion having no electrostatic latent image formed thereon in the image carrying member 10, while being supplied to only the portion having the electrostatic latent image formed thereon are not clear, they are presumed as follows by the inventors and others of the present invention.

(1) A layer of the ink 42 held on the surface of the ink carrying member 41 first approaches the image carrying member 10 coated with the release agent 32, so that the layer of the ink 42 on the surface of the ink carrying member 41 is brought into contact with a layer of the release agent 32 on the surface of the image carrying member 10.

(2) In a portion having the electrostatic latent image formed thereon, charge having a polarity opposite to the polarity of charge on the surface of the image carrying member is induced on the surface of the ink 42 through the layer of the release agent 32 on the image carrying member 10 by the charge on the surface of the image carrying member 10. Consequently, the layer of the ink 42 is drawn toward the image carrying member 10 upon receipt of an electrostatic attraction force, and is moved in such a manner as to put aside the layer of the release agent 32, to adhere on the surface of the image carrying member 10.

(3) When the ink carrying member 41 is separated from the image carrying member 10 so that the spacing therebetween exceeds a predetermined value, an adhesive force between the layer of the ink 42 and the image carrying member 10 exceeds the cohesive force of the ink 42 in the portion having the electrostatic latent image formed thereon, so that the layer of the ink 42 is cut to predetermined thicknesses. The ink 42 remains on the side of the image carrying member 10, so that an ink image is formed.

(4) On the other hand, the layer of the ink 42 brought into contact with the portion having no electrostatic latent image formed thereon is not transferred toward the image carrying member 10 by the cohesive force of the ink 42 itself. A portion of the release agent 32 is cut, so that the ink 42 is returned to the ink carrying member 41.

In forming the ink image corresponding to the electrostatic latent image on the surface of the image carrying member 10 using the ink 42 having a tack value of not less than one as described above, the ink 42 is prevented from adhering on the portion having no electrostatic latent image formed thereon in the image carrying member 10, and is sufficiently supplied to the portion having the electrostatic latent image formed thereon by suitably setting the speed at which the image carrying member 10 is moved and the nip width from the position where the ink carrying member 41 and the image carrying member 10 are brought into contact with each other to the position where they are separated from each other.

In thus supplying the ink 42 to the image carrying member 10 from the ink carrying member 41, to form the ink image corresponding to the electrostatic latent image, when the ink carrying member 41 is brought into contact with the image carrying member 10 in such a manner as to be pressed hard thereagainst, the formed image is liable to be fogged. Therefore, it is preferable that the ink carrying member 41 is brought into contact with the image carrying member 10 in such a manner that strong pressure is not applied thereto.

The ink image formed on the surface of the image carrying member 10 in the above-mentioned manner is then transferred onto a recording medium 6 by a transfer device 50.

In the present embodiment, a transfer roller 50 is used as the transfer device 50, and transfer paper 6 such as plain paper is used as the recording medium 6.

In transferring the ink image formed on the surface of the image carrying member 10 onto the transfer paper 6 by the transfer roller 50, the transfer paper 6 contained in a paper feeding tray 61 is fed by a paper feeding roller 62, to introduce the transfer paper 6 into a portion between the image carrying member 10 having the ink image formed thereon as described above and the transfer roller 50, and the ink image formed on the surface of the image carrying member 10 is transferred onto the transfer paper 6 under pressure by the transfer roller 50.

The transfer paper 6 to which the ink image is thus transferred is conveyed by a conveying belt 63 and is discharged into a discharge tray 64, while the ink 42 remaining on the surface of the image carrying member 10 after the transfer is removed from the surface of the image carrying member 10 by a cleaning device 70. Thereafter, charge on the surface of the image carrying member 10 is eliminated by a charge eliminating device 80. The above-mentioned operations are repeated, to form an image.

As a result, a good image which has a sufficient image density and is not fogged can be formed on the transfer paper 6.

(Embodiment 2)

Figure 2:
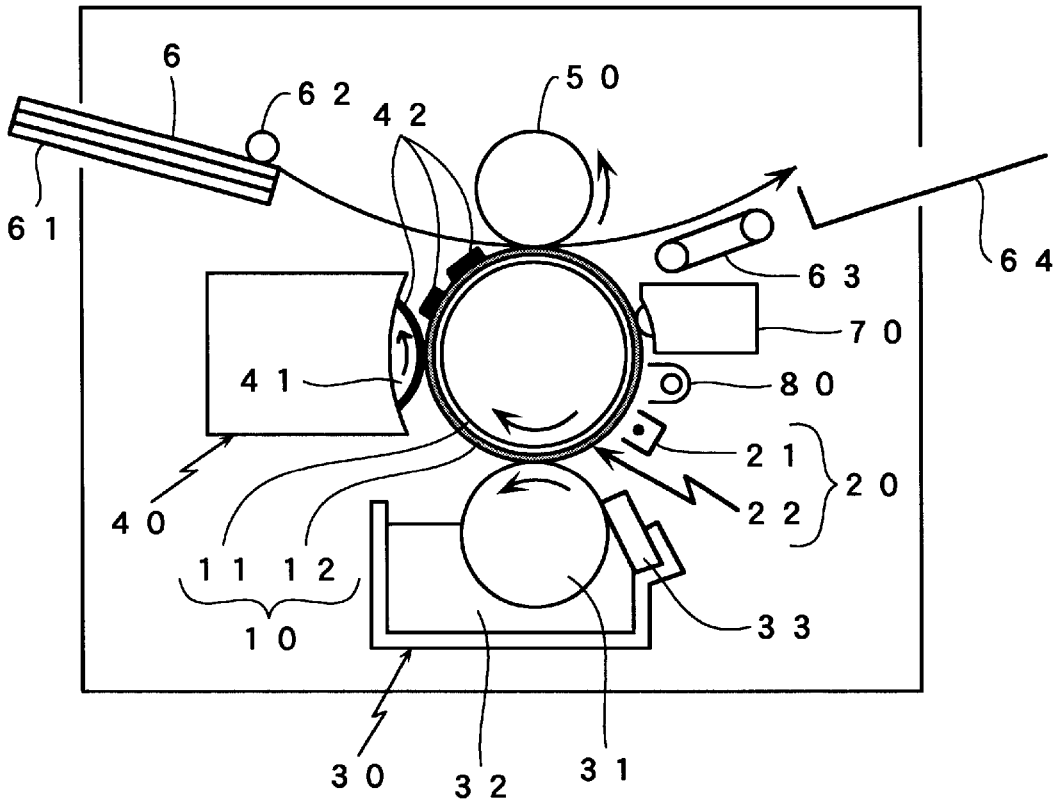
FIG. 2 is a schematic explanatory view of an image forming apparatus according to an embodiment 2 of the present invention.

In the present embodiment 2, an electrophotographic photoreceptor so constructed that a photosensitive layer 12 is formed on the surface of an electrically conductive member 11 in a cylindrical shape is used as an image carrying member 10, as shown in FIG. 2. In forming an electrostatic latent image on the surface of the image carrying member 10 by a latent image forming device 20, the surface of the image carrying member 10 is charged by a charger 21, and the charged surface of the image carrying member 10 is subjected to exposure corresponding to image information by a suitable exposing device 22, to form an electrostatic latent image on the surface of the image carrying member 10.

After the electrostatic latent image is thus formed on the surface of the image carrying member 10, a non-conductive release agent 32 is applied to the surface of the image carrying member so as to have a predetermined thickness by a release agent application device 30, as in the above-mentioned embodiment 1.

An example of ink 42 is one having a tack value of not less than one, as in the embodiment 1. The ink 42 is held on the surface of an ink carrying member 41 in an ink developing device 40, and is brought into contact with the surface of the image carrying member 10 coated with the release agent 32 as described above, as in the embodiment 1. In the present embodiment, a bias voltage is exerted on the ink carrying member 41 from a power supply (not shown) to apply the ink 42 to a portion of the electrostatic latent image formed on the surface of the image carrying member 10, to form an ink image corresponding to the electrostatic latent image on the surface of the image carrying member 10.

The ink image formed on the surface of the image carrying member 10 in the above-mentioned manner is transferred to transfer paper 6 by a transfer roller 50, as in the embodiment 1, while the ink 42 remaining on the surface of the image carrying member 10 after the transfer is removed from the surface of the image carrying member 10 by a cleaning device 70. Thereafter, charge on the surface of the image carrying member 10 is eliminated by a charge eliminating device 80 using an eraser lamp. The above-mentioned operations are repeated, to form an image.

Also in a case where the image is formed using the image forming apparatus according to the embodiment 2, a good image which is prevented from being fogged and has a sufficient image density is obtained on the transfer paper 6, as in the image forming apparatus according to the embodiment 1.

(Experimental Examples 1 to 3)

In the experimental examples 1 to 3, an image carrying member so constructed that a dielectric layer 12 having a thickness of 20 $\mu$m composed of polyamide resin is formed on the surface of an electrically conductive member 11 composed of an aluminum drum was used as the image carrying member 10, while discharges were induced using a multi-stylus discharge electrode using a copper wire having a diameter of 50 $\mu$m as the discharge electrode 20, to form an electrostatic latent image having a surface potential of approximately—600 V on the surface of the image carrying member 10.

In applying silicone oil 32 to the surface of the image carrying member 10 having the electrostatic latent image thus formed thereon from the application roller 31, Silicone oil SH200 (Trade Name) manufactured by Toray Dow Coning Silicone Co., Ltd. was used as the silicone oil 32. The silicone oil 32 was applied to the surface of the image carrying member 10 having the electrostatic latent image formed thereon so as to have a thickness of approximately 0.5 $\mu$m.

On the other hand, examples of the ink 42 were ink so adjusted as to have a viscosity of 20000 cP, have a tack value of 10, and have an electrical resistivity of 10–9Ω·cm by adding No. 2 ML Reducer (Trade Name) manufactured by T&K TOKA Co., Ltd. and No. 2 Contex (Trade Name) manufactured by T&K TOKA Co., Ltd. to commercially available ink having a viscosity of 285000 cP and having a tack value of 38 (Best Cure OL SD 797 India Ink 1L: manufactured by T&K TOKA Co., Ltd.) in the experimental example 1, ink having a viscosity of 90000 cP, having a tack value of 0.1, and having an electrical resistivity of $10^{-9}$Ω·cm (CD501: manufactured by Gestettoner Co., Ltd.) in the experimental example 2, and ink so adjusted as to have a viscosity of 280000 cP, have a tack value of 80, and have an electrical resistivity of $10^{-9}$Ω·cm by adding No. 2 ML Reducer (Trade Name) manufactured by T&K TOKA Co., Ltd. and No. 2 Contex (Trade Name) manufactured by T&K TOKA Co., Ltd. to commercially available ink having a tack value of 90 (Best Cure OL SD 797 India Ink H: manufactured by T&K TOKA Co., Ltd.) in the experimental example 3. The viscosity of each of the above-mentioned types of ink 42 is a value measured using an E-shaped viscosimeter (VISCONIC ED: manufactured by Tokyo Keiki Co., Ltd.) and under measuring conditions of 3°×R7·7 Corn, 0.5 rpm, and 25° C. The tack value is a value measured using Incometer (manufactured by Toyoei Seiko Co., Ltd.) and under measuring conditions of 400 rpm and 23° C.

The ink 42 was held on the surface of the ink carrying member 41, and was so adjusted as to have a thickness of approximately 10 $\mu$m. Further, such adjustment was made that the nip width from the position where the ink carrying member 41 having the ink 42 held therein and the image carrying member 10 coated with the silicone oil 32 are brought into contact with each other to the position where they are separated from each other was 2 mm, and the contact pressure between the ink carrying member 41 and the image carrying member 10 was a line pressure of 0.07 kg/mm. The ink 42 held on the surface of the ink carrying member 41 was brought into contact with the surface of the image carrying member 10 coated with the silicone oil 32, to form an ink image on the surface of the image carrying member 10, and the ink image thus formed was transferred onto the transfer paper 6 from the surface of the image carrying member 10 by the transfer roller 50 as described above, to form an image.

In each of the experimental examples 1 to 3, the system speed was changed to form an image, and the formed image was evaluated.

Figure 3:
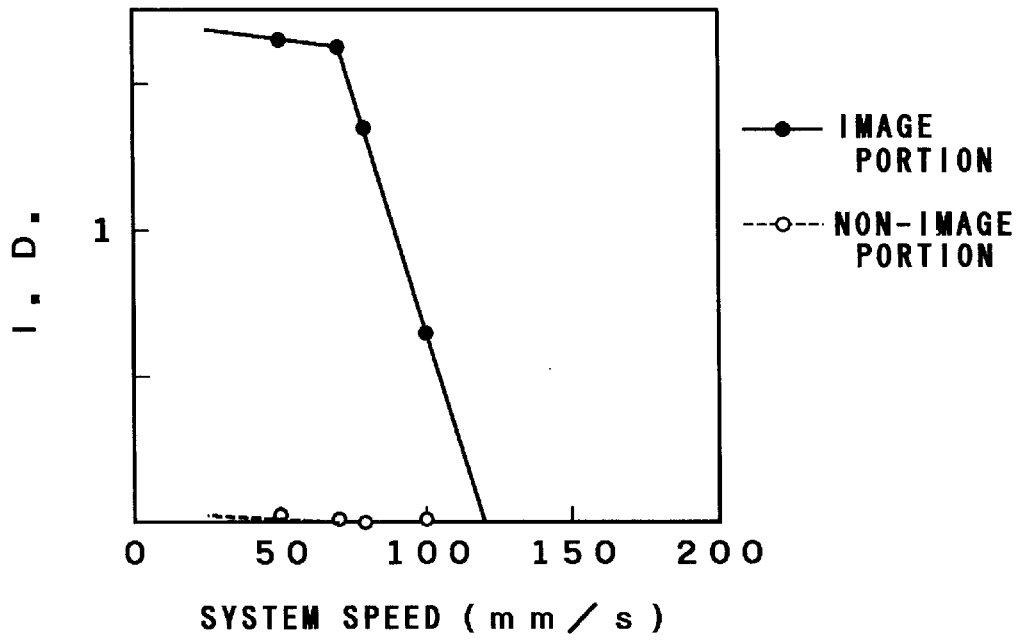
FIG. 3 is a diagram showing such a relationship that an image density in an image portion having an electrostatic latent image formed thereon and an image density in a non-image portion having no electrostatic latent image formed thereon change as the system speed changes in an experimental example 1 using ink having a tack value of 10 in the image forming apparatus according to the embodiment 1.
Figure 4:
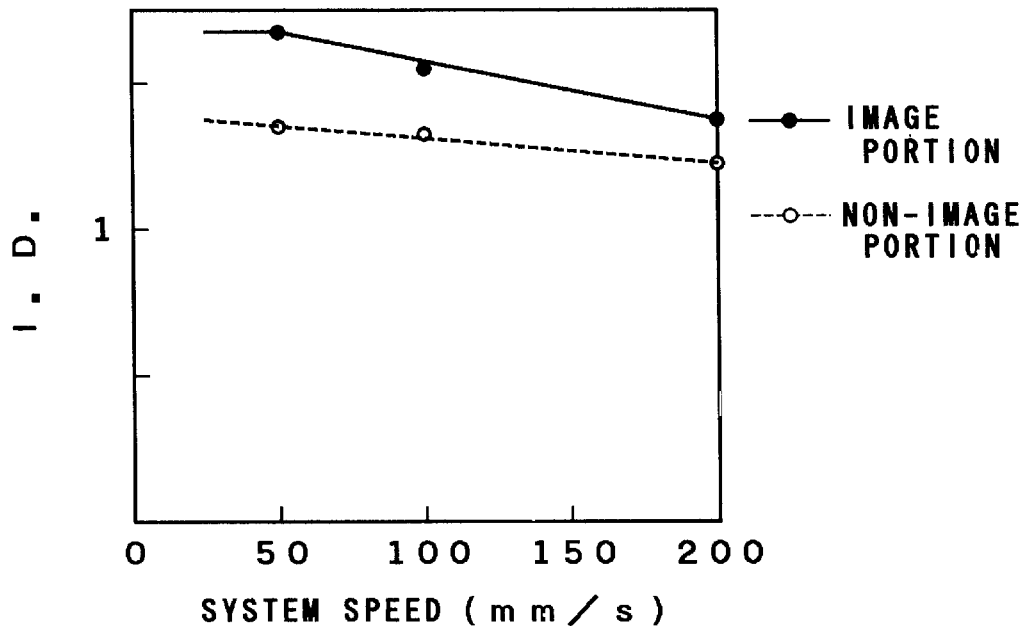
FIG. 4 is a diagram showing such a relationship that an image density in an image portion having an electrostatic latent image formed thereon and an image density in a non-image portion having no electrostatic latent image formed thereon change as the system speed changes in an experimental example 2 using ink having a tack value of 0.1 in the image forming apparatus according to the embodiment 1.
Figure 5:
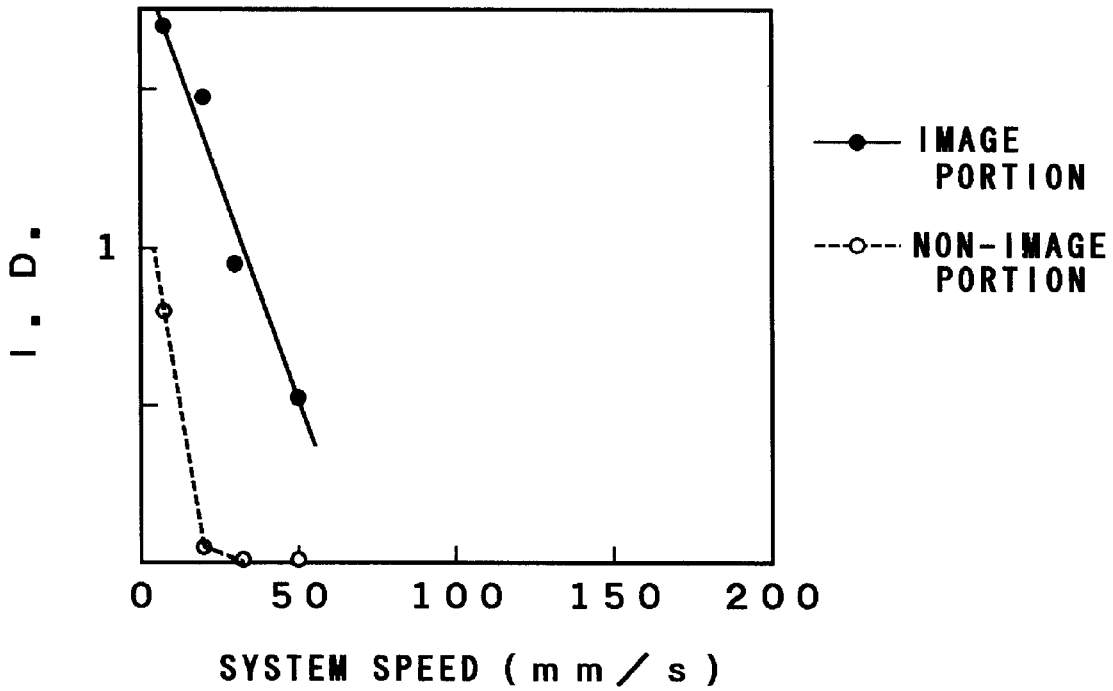
FIG. 5 is a diagram showing such a relationship that an image density in an image portion having an electrostatic latent image formed thereon and an image density in a non-image portion having no electrostatic latent image formed thereon change as the system speed changes in an experimental example 3 using ink having a tack value of 80 in the image forming apparatus according to the embodiment 1.

In evaluating the formed image, image densities (I.D.) in an image portion having the electrostatic latent image formed thereon and a non-image portion having no electrostatic latent image formed thereon were respectively measured using a reflection densitometer (Sakura Densitometor PDA65). The results in the experimental example 1 using the ink having a viscosity of 20000 cP, having a tack value of 10, and having an electrical resistivity of $10^{-9}\Omega\cdot$cm, the results in the experimental example 2 using the ink having a viscosity of 90000 cP, having a tack value of 0.1, and having an electrical resistivity of $10^{-9}\Omega\cdot$cm, and the results in the experimental example 3 using the ink having a viscosity of 280000 cP, having a tack value of 80, and having an electrical resistivity of $10^{-9}\Omega\cdot$cm were respectively shown in FIGS. 3, 4, and 5. In FIGS. 3, 4, and 5, the change in the image density (I.D.) in the image portion with the change in the system speed was indicated by a solid line, and the change in the image density (I.D.) in the non-image portion with the change in the system speed was indicated by a broken line.

As a result, in the experimental example 1 using the ink having a tack value of 10, the difference between the image densities in the image portion and the non-image portion was increased in a case where the system speed was in a predetermined range. When an image was formed at a system speed in this range, the image was a good image which was not fogged and had a sufficient image density. On the other hand, in the experimental example 2 using the ink having a tack value of 0.1 which is not more than 1, even if the system speed is changed, the image density in the non-image portion is high, so that the formed image was vigorously fogged.

In the experimental example 3 using the ink having a tack value of 80 which is not less than one, the image density in the image portion was rapidly decreased as the system speed was increased. If the system speed was increased, an image having a sufficient image density was not obtained.

When the image was formed in the above-mentioned manner using ink so adjusted as to have a tack value of 30 by adding No. 2 ML Reducer (Trade Name) manufactured by T&K TOKA Co., Ltd. and No. 2 Contex (Trade Name) manufactured by T&K TOKA Co., Ltd. to commercially available ink (Best Cure OL SD 797 India Ink 1L: manufactured by T&K TOKA Co., Ltd.), and ink so adjusted as to have a tack value of 60 by adding No. 2 ML Reducer (Trade Name) manufactured by T&K TOKA Co., Ltd. and No. 2 Contex (Trade Name) manufactured by T&K TOKA Co., Ltd. to commercially available ink (Best Cure OL SD 797 India Ink H: manufactured by T&K TOKA Co., Ltd.), the same results as those in the experimental example 1 using the ink having a tack value of 10 were obtained. This showed that ink having a tack value of 1 to 80 was preferably used as the ink 42, and ink having a tack value of 10 to 60 was more preferably used as the ink 42.

(Embodiment 3)

Figure 6:
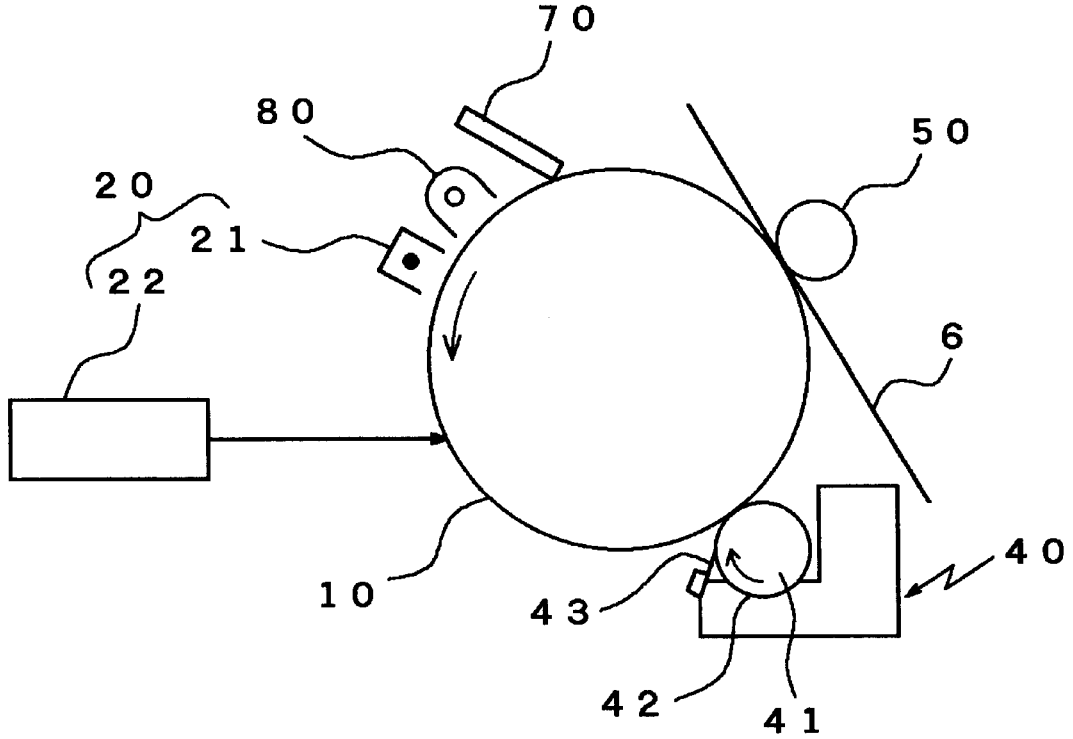
FIG. 6 is a schematic explanatory view of an image forming apparatus according to an embodiment 3 of the present invention.

In the present embodiment 3, an electrophotographic photoreceptor so constructed that a photosensitive layer is formed on the surface of a cylindrical electrically conductive member is used as an image carrying member 10. The image carrying member 10 is rotated, and an electrostatic latent image is formed on the surface of the image carrying member 10 by a latent image forming device 20, as shown in FIG. 6.

In forming the electrostatic latent image on the surface of the image carrying member 10 by the latent image forming device 20, the surface of the image carrying member 10 is charged by a charger 21, and the charged surface of the image carrying member 10 is subjected to exposure corresponding to image information by a suitable exposing device 22, to from the electrostatic latent image on the surface of the image carrying member 10.

Ink 42 is supplied from an ink developing device 40 to the surface of the image carrying member 10 having the electrostatic latent image thus formed thereon, to form an ink image corresponding to the electrostatic latent image on the surface of the image carrying member 10.

In the present embodiment, in supplying the ink 42 to the surface of the image carrying member 10 having the electrostatic latent image formed thereon from the ink developing device 40, the ink 42 is held on the surface of an ink carrying member 41 rotated. The thickness of the ink 42 thus held on the surface of the ink carrying member 41 is regulated by a regulating plate 43, to make such adjustment that the thickness of the ink 42 is a predetermined thickness.

In thus making such adjustment that the thickness of the ink 42 held on the surface of the ink carrying member 41 is a suitable thickness by the regulating plate 43, in a case where Vs (mm/s) is taken as the speed at which the surface of the ink carrying member 41 is moved, E (kgf/mm$^2$) is taken as the Young's modulus of the regulating plate 43, L (mm) is taken as the length of a portion where the regulating plate 43 is in contact with the ink 42 in the direction in which the ink carrying member 41 is moved, t (mm) is taken as the thickness of the regulating plate 43, and $\eta$ ($\gamma$) (cP) is taken as the viscosity of the ink 42 at the shear rate $\gamma$ (/s) thereof, the relationship of $44.8\times10^{-6}\times E\times t^3/(L^4\times Vs)\leqq\eta(\gamma)\leqq902.8\times10^{-6}\times E\times t^3/(L^4\times Vs)$ is satisfied.

When the thickness of the ink 42 held on the surface of the ink carrying member 41 is regulated by the regulating plate 43 in such a manner as to satisfy the above-mentioned relationship, the thickness of the ink 42 on the surface of the ink carrying member 41 is regulated in the range of a suitable thickness of approximately 5 to 20 $\mu$m.

Figure 7:
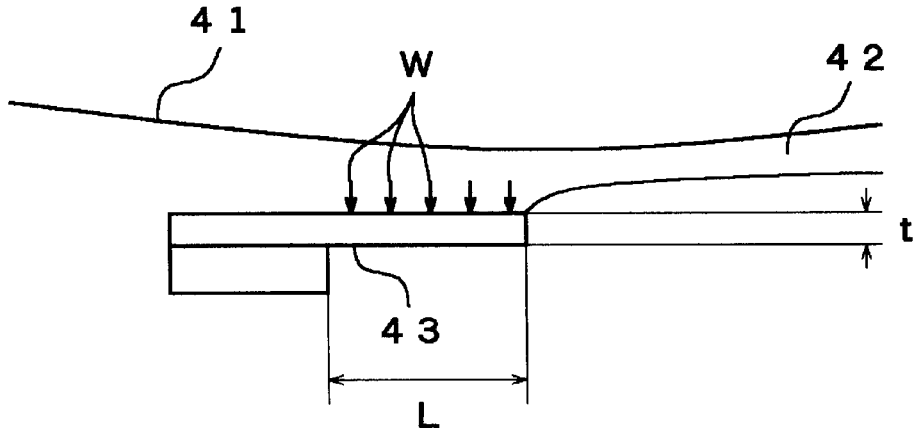
FIG. 7 is a partially enlarged explanatory view showing a state where the thickness of ink held in an ink carrying member is adjusted by a regulating plate in the image forming apparatus according to the embodiment 3.

The reason why if the thickness of the ink 42 held on the surface of the ink carrying member 41 is regulated by the regulating plate 43 in such a manner as to satisfy the above-mentioned relationship, the thickness of the ink 42 on the surface of the ink carrying member 41 is regulated in the range of a suitable thickness of approximately 5 to 20 $\mu$m will be described on the basis of FIG. 7.

In a case where E (kgf/mm$^2$) is taken as the Young's modulus of the regulating plate 43, L (mm) is taken as the length of the portion where the regulating plate is in contact with the ink 42, and t (mm) is taken as the thickness of the regulating plate 43, the amount of deflection h in the regulating plate 43 is as follows, letting w be a distributed load applied to the regulating plate 43 by the flow of the ink 42:

$$h=3\times w\times L^4/(2\times E\times t^3) \quad (1)$$

On the other hand, the distributed load w applied to the regulating plate 43 by the flow of the ink 42 is as follows:

$$w=\eta(\gamma)\times\gamma \quad (2)$$

Letting V (mm/s) be the speed at which the surface of the ink carrying member 41 is moved, the following equation is obtained:

$$\gamma=Vs/h \quad (3)$$

When the equation (3) is substituted into the foregoing equation (2), the distributed load w is as follows:

$$w=\eta(\gamma)\times Vs/h \quad (4)$$

When the distributed load w is substituted into the foregoing equation (1), to find the amount of deflection h in the regulating plate 43, the foregoing equation is obtained:

$$h=(3\times L^4\times\eta(\gamma)\times Vs/(2\times E\times t^3))^{1/2} \quad (5)$$

The value of η (γ) is as follows from the equation (5):

$$\eta(\gamma)=2\times h^2\times E\times t^3/(3\times L^4\times Vs) \quad (6)$$

In a case where the thickness x (mm) of the ink 42 on the surface of the ink carrying member 41 is adjusted by the regulating plate 43 as described above, it is approximately 0.6 times the amount of deflection h of the regulating plate 43. When x/0.6 is substituted into h in the foregoing equation (6), the thickness x of the ink 42 on the surface of the ink carrying member 41 is in the range of 5 to 20 μm in a case where ink 42 whose viscosity η (γ) at the shear rate γ (/s) satisfies the above-mentioned relationship is used.

Figure 8:
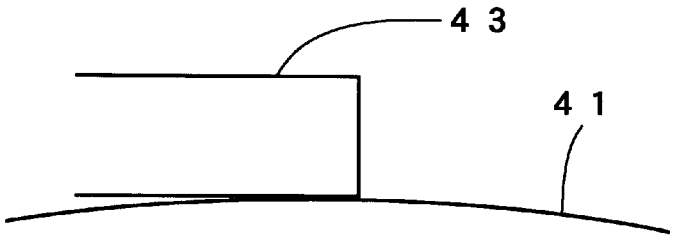
FIGS. 8(A), 8(B) and 8(C) are partially enlarged explanatory views showing three modes in which a regulating plate is brought into contact with the surface of an ink carrying member in the image forming apparatus according to the embodiment 3.
Figure 8:
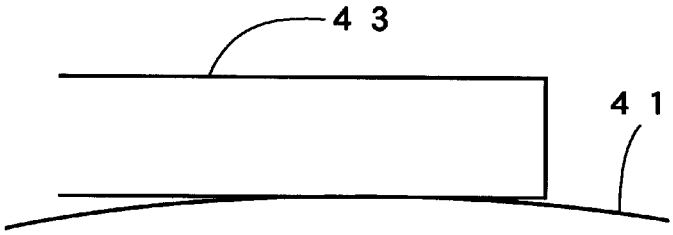
Figure 8:
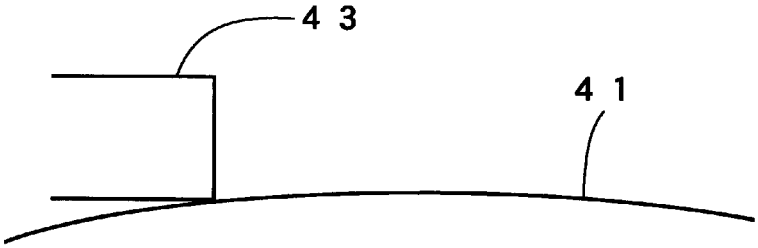

In adjusting the thickness of the ink 42 held on the surface of the ink carrying member 41 by the regulating plate 43 as described above, it is preferable that an end of the regulating plate 43 is brought into contact with the surface of the ink carrying member 41 in such a manner as to be along a tangent to the ink carrying member 41 on the surface thereof, as shown in FIG. 8(A). That is, when the end of the regulating plate 43 is thus brought into contact with the surface of the ink carrying member 41 in such a manner as to be along the tangent to the ink carrying member 41 on the surface thereof, the thickness of the ink 42 held on the surface of the ink carrying member 41 is not non-uniform. Therefore, the ink 42 having a uniform and suitable thickness is held on the surface of the ink carrying member 41.

On the other hand, when the end of the regulating plate 43 is further projected from a portion where the regulating plate 43 is in contact with the surface of the ink carrying member 41, as shown in FIG. 8(B), tensile stress is produced in the ink 42 passing between the regulating plate 43 and the surface of the ink carrying member 41 in a portion of the regulating plate 43 thus projected, so that the thickness of the ink 42 on the surface of the ink carrying member 41 is locally non-uniform. If the length of the regulating plate 43 projected from the portion where the regulating plate 43 is in contact with the surface of the ink carrying member 41 is within 1 mm, the thickness of the ink 42 is hardly locally non-uniform.

When only a corner of the end of the regulating plate 43 is brought into contact with the surface of the ink carrying member 41, as shown in FIG. 8(c), the thickness of the ink 42 on the surface of the ink carrying member 41 is non-uniform in a stripe shape by irregularities at the corner of the end of the regulating plate 43. When an angle between the end of the regulating plate 43 and the tangent to the ink carrying member 41 in the portion where the end is in contact with the image carrying member 41 is within 5°, the thickness of the ink 42 is hardly non-uniform in a stripe shape.

The ink 42 whose thickness is regulated by the regulating plate as described above so as to be a suitable thickness on the surface of the ink carrying member 41 is brought into contact with the surface of the image carrying member 10 having the electrostatic latent image formed thereon. Further, in the present embodiment, a bias voltage is exerted on the ink carrying member 41 from a power supply (not shown) to apply the ink 42 to a portion of the electrostatic latent image formed on the surface of the image carrying member 10, to form an ink image corresponding to the electrostatic latent image on the surface of the image carrying member 10.

After the ink image is thus formed on the surface of the image carrying member 10, the ink image formed on the surface of the image carrying member 10 is transferred to transfer paper 6 by a transfer roller 50, to form the ink image on the transfer paper 6, as in the above-mentioned embodiment 2. On the other hand, the ink 42 remaining on the surface of the image carrying member 10 after the transfer is removed from the surface of the image carrying member 10 by a cleaning device 70, after which charge on the surface of the image carrying member 10 is eliminated by a charge eliminating device 80 using an eraser lamp. The above-mentioned operations are repeated, to form an image.

A good image which has a sufficient image density and is not fogged, for example, can be formed on the transfer paper 6 in the above-mentioned manner.

(Experimental Example 4)

Figure 9:
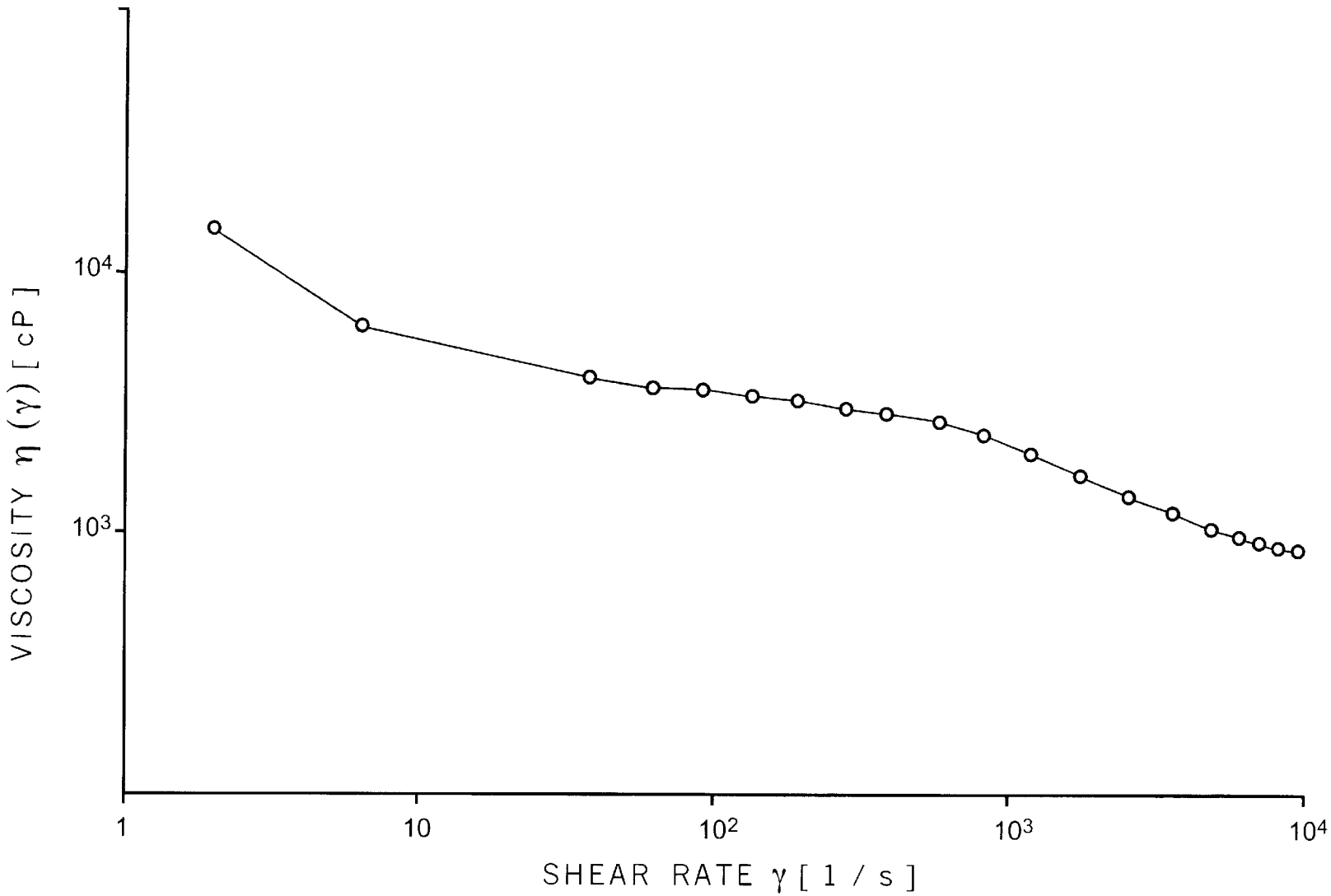
FIG. 9 is a diagram showing the relationship between the viscosity $\eta$ ($\gamma$) and the shear rate $\gamma$ of ink used in an experimental example 4 using the image forming apparatus according to the embodiment 3.

In this experimental example, particular ink was first used, to examine the relationship between the shear rate γ and the viscosity η (γ) of the ink. The results thereof were shown in FIG. 9. As a result, as the shear rate γ of the ink changed, the viscosity η (γ) of the ink also changed. The viscosity η (γ) of the ink was measured using a rotation type viscosimetor (RS-50: manufactured by HAAKE Co., Ltd.).

A regulating plate manufactured by SUS Co., Ltd. so constructed as to have a Young's modulus E of 21600 kgf/mm$^2$, have a length L of 5 mm in its part in contact with the ink 42, and have a thickness t of 0.188 mm was used as the regulating plate 43, while ink so adjusted as to have a predetermined viscosity by adding a viscosity adjustor (No. 2 ML Reducer: manufactured by TOKA Co., Ltd.) to Best Cure OL SD 797 India Ink 1L (Trade Name) manufactured by T&K Co., Ltd. was used as the ink 42.

Figure 10:
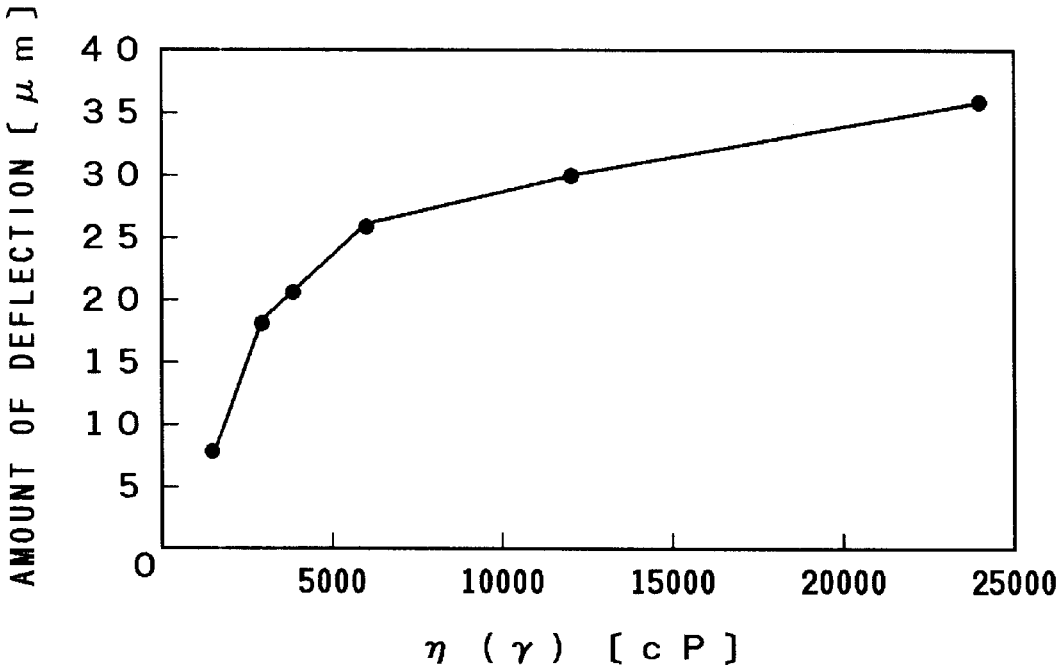
FIG. 10 is a diagram showing, in a case where the thickness of ink held on the surface of an ink carrying member is adjusted by a regulating plate, letting the speed Vs at which the surface of the ink carrying member is moved be 20 mm/s in the experimental example 4, the relationship between the viscosity $\eta$ ($\gamma$) of the ink and the amount of deflection of the regulating plate.

The speed Vs at which the surface of the ink carrying member 41 is moved was set to 20 mm/s, to adjust the thickness of the ink 42 held on the surface of the ink carrying member 41 by the regulating plate 43. The relationship between the viscosity η (γ) (cP) of the ink 42 and the amount of deflection (μm) of the regulating plate 43 was examined. The results thereof were shown in FIG. 10.

When ink 42 having a viscosity η (γ) of approximately of 4000 cP at a shear rate γ of 1000/s was used, the amount of deflection of the regulating plate 43 was approximately 20 μm. It was possible to set the thickness of the ink 42 held on the surface of the ink carrying member 41 to approximately 12 μm by the regulating plate 43.

Figure 11:
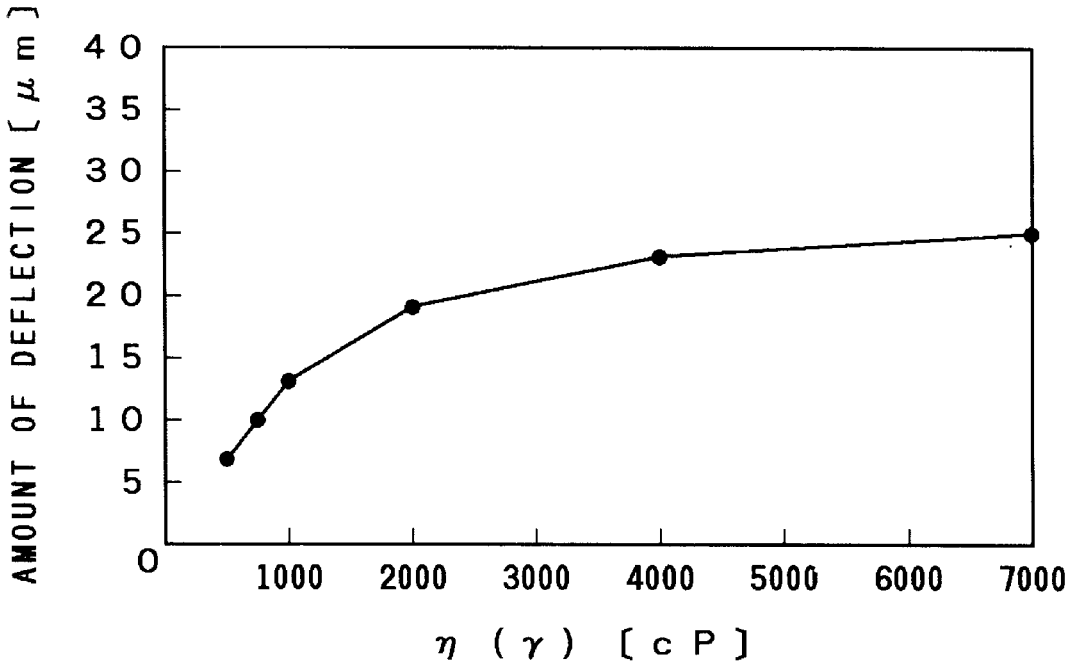
FIG. 11 is a diagram showing, in a case where the thickness of ink held on the surface of an ink carrying member is adjusted by a regulating plate, letting the speed Vs at which the surface of the ink carrying member is moved be 50 mm/s in the experimental example 4, the relationship between the viscosity η (γ) of the ink and the amount of deflection of the regulating plate.

The speed Vs at which the surface of the ink carrying member 41 is moved was set to 50 mm/s, to adjust the thickness of the ink 42 held on the surface of the ink carrying member 41 by the regulating plate 43. The relationship between the viscosity η (γ) (cP) of the ink 42 and the amount of deflection (μm) of the regulating plate 43 was examined. The results thereof were shown in FIG. 11.

When ink having a viscosity η (γ) of approximately 800 cP at a shear rate γ of 5000/s was used as the ink 42, the amount of deflection of the regulating plate 43 was approximately 10 μm. It was possible to set the thickness of the ink 42 held on the surface of the ink carrying member 41 to approximately 6 μm by the regulating plate 43.

When the ink image formed on the surface of the image carrying member 10 as described above was transferred onto the transfer paper 6 by the transfer roller 50, to form the ink image on the transfer paper 6, it was preferable to use ink having a viscosity η (γ) of 5000 to 50000 cP at a shear rate γ of 2/s as the ink 42 in order that the ink image formed on the surface of the image carrying member 10 was efficiently transferred onto the transfer paper 6.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. An image forming apparatus comprising:

an image carrying member having an electrostatic latent image carried on its surface;

an ink developing device containing ink having a tack value of not less than one and comprising an ink carrying member for holding the ink, the ink developing device bringing said ink into contact with the electrostatic latent image formed on said image carrying member, to form an ink image on the image carrying member; and a transfer device for transferring onto a recording medium the ink image formed on the image carrying member.

2. The image forming apparatus according to claim 1, wherein the tack value of said ink is 1 to 80.

3. The image forming apparatus according to claim 1, wherein the tack value of said ink is 10 to 60.

4. The image forming apparatus according to claim 1, wherein said image carrying member is constructed by forming a dielectric layer on a conductive base substrate.

5. The image forming apparatus according to claim 1, wherein the thickness of the ink held on said ink carrying member is 1 to 50 μm.

6. The image forming apparatus according to claim 1, comprising a release agent application device for applying a release agent to the image carrying member.

7. An image forming apparatus comprising:

an image carrying member having an electrostatic latent image carried on its surface; and an ink developing device comprising an ink carrying member for holding ink and a regulating plate for adjusting the thickness of the ink held in the ink carrying member, the ink developing device bringing said ink into contact with the electrostatic latent image formed on said image carrying member, to from an ink image on the image carrying member, wherein the relationship of $44.8\times10^{-6}\times E\times t^3/(L^4\times Vs)\leqq\eta(\gamma)\leqq902.8\times10^{-6}\times E\times t^3/(L^4\times Vs)$ is satisfied, where E: the Young's modulus (kgf/mm$^2$) of the regulating plate, t: the thickness (mm) of the regulating plate, L: the length (mm) of a portion where the regulating plate is in contact with the ink in the direction in which the surface of the ink carrying member is moved, Vs: the speed (mm/s) at which the surface of the ink carrying member is moved, and η(γ): the viscosity (cP) of the ink at the shear rate γ(/s) thereof.

8. The image forming apparatus according to claim 7, wherein said image carrying member is constructed by forming a dielectric layer on a conductive base substrate.

9. The image forming apparatus according to claim 7, further comprising a transfer device for transferring onto a recording medium the ink image formed on the image carrying member.

10. The image forming apparatus according to claim 9, wherein said transfer device comprises a transfer roller, and the viscosity of the ink in a case where the shear rate thereof is 2/s is 5000 to 50000 cP.

11. The image forming apparatus according to claim 7, further comprising a release agent application device for applying a release agent to the image carrying member.

12. An image forming method comprising the steps of:

forming an electrostatic latent image on an image carrying member;

developing the electrostatic latent image formed on said image carrying member by ink having a tack value of not less than one, to form an ink image on the image carrying member; and transferring onto a recording medium the ink image formed on said image carrying member.

13. The method according to claim 12, wherein the tack value of said ink is 1 to 80.

14. The method according to claim 13, wherein the tack value of said ink is 10 to 60.

15. The method according to claim 12, further comprising the step of applying the release agent to the image carrying member after said step of forming the electrostatic latent image.

16. An image forming method comprising the steps of:

forming an electrostatic latent image on an image carrying member; and developing the electrostatic latent image formed on said image carrying member using an ink developing device comprising an ink carrying member for holding ink and a regulating plate for adjusting the thickness of the ink held in the ink carrying member, to form an ink image on the image carrying member, wherein the relationship of $44.8\times10^{-6}\times E\times t^3/(L^4\times Vs)\leqq\eta(\gamma)\leqq902.8\times10^{-6}\times E\times t^3/(L^4\times Vs)$ is satisfied, where E the Young's modulus (kgf/mm$^2$) of the regulating plate, t: the thickness (mm) of the regulating plate, L: the length (mm) of a portion where the regulating plate is in contact with the ink in the direction in which the surface of the ink carrying member is moved, Vs: the speed (mm/s) at which the surface of the ink carrying member is moved, and $\eta(\gamma)$: the viscosity (cP) of the ink at the shear rate $\gamma$(/s) thereof.

17. The method according to claim 16, comprising the step of transferring onto the recording medium the ink image formed on the image carrying member.

18. The method according to claim 16, comprising the step of applying a release agent to the image carrying member after said step of forming the electrostatic latent image.

* * * * *